US006242998B1

(12) United States Patent
Mihara

(10) Patent No.: US 6,242,998 B1
(45) **Date of Patent: *Jun. 5, 2001**

(54) NTC THERMISTORS

(75) Inventor: Kenjiro Mihara, Shiga (JP)

(73) Assignee: Murata Manufacturing Co., Ltd., Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/304,705

(22) Filed: May 4, 1999

(30) Foreign Application Priority Data

May 22, 1998 (JP) ..... 10-141418

(51) Int. Cl.[7] ..... H01C 7/13

(52) U.S. Cl. ..... 338/22 R; 338/221; 338/232; 338/276

(58) Field of Search ..... 338/20, 22 R, 338/225 D, 23, 221, 232, 276

(56) References Cited

U.S. PATENT DOCUMENTS 2,698,372 * 12/1954 Patla ..... 338/276
3,925,748 * 12/1975 Slocum ..... 338/57
4,395,623 * 7/1983 Shimada et al. ..... 338/22 R
4,698,614 * 10/1987 Welch et al. ..... 338/22 R
5,051,718 * 9/1991 Satake et al. ..... 338/34
5,142,265 * 8/1992 Motoyoshi et al. ..... 338/22 R
5,504,371 * 4/1996 Niimi et al. ..... 257/703
5,703,000 * 12/1997 Nakayama et al. ..... 501/152
5,714,924 * 2/1998 Takeuchi et al. ..... 338/22 R
5,760,336 * 6/1998 Wang ..... 338/234
5,764,470 * 6/1998 Mihara et al. ..... 338/22 R

* cited by examiner

*Primary Examiner*—Karl D. Easthom
(74) *Attorney, Agent, or Firm*—Coudert Brothers

(57) ABSTRACT

An NTC thermistor is formed with a planar NTC thermistor element, a pair of power-supply terminals and a case which encloses the thermistor element and the terminals inside. The planar NTC thermistor has electrodes formed on a mutually opposite pair of side surfaces and each contacted by one of the power-supply terminals. At least one of the main surfaces of the planar NTC thermistor makes a surface-to-surface contact with an inner wall of the case such that the effective thermal capacity of the thermistor element is increased. Such an NTC thermistor, when inserted in series between an electrical power source and an electrical heat source, say, of an electronic copier, can effectively suppress rush currents when the power source is switched on.

16 Claims, 3 Drawing Sheets

NTC THERMISTORS

BACKGROUND OF THE INVENTION

This invention relates to negative temperature characteristic (NTC) thermistors for suppressing rush currents.

NTC thermistors are characterized as having lower resistance at elevated temperatures than at the normal temperature. Because of this unique characteristic, NTC thermistors are frequently utilized as a circuit element incorporated in a power source circuit of a device for suppressing the rush current which may flow into the source circuit at the instant when the power switch for the device is turned on.

As shown in FIG. 6, a prior art NTC thermistor 1 of a type enclosed inside a case and used for suppressing rush currents is generally structured so as to have elongated power-supply terminals 5 and 6 connected to electrodes 3 and 4 formed on two mutually opposite main surfaces of a circular disk-shaped thermistor element 2, both the thermistor element 2 and the power-supply terminals 5 and 6 being enclosed inside a heat-resistant resin case 7. The thermistor element 2 is supported by and sandwiched between the tips of the terminals 5 and 6 inside the hollow internal space of the resin case 7, while the other ends of the terminals 5 and 6 penetrate the body of the resin case 7, extending to its exterior.

One of the methods of improving the effect of such an NTC thermistor 1 to suppress a rush current has been to increase the volume of the NTC thermistor element 2 so as to increase its heat capacity such that the rise of its temperature due to the heat emitted by itself will be limited and the lowering of its resistance can be reduced. This method is not a practical one, however, because the cost of the NTC thermistor element takes up a large portion of the total cost of the product and the cost of the NTC thermistor element will increase if its volume, or its size, is increased.

SUMMARY OF THE INVENTION

It is therefore an object of this invention to provide NTC thermistors of the type enclosed in a case which can suppress rush currents effectively without using an NTC thermistor element with a large volume.

An NTC thermistor embodying this invention, with which the above and other objects can be accomplished, may be characterized not only as comprising power-supply terminals connected to electrodes individually formed on a pair of mutually opposite side surfaces of a planar NTC thermistor element and having a case which encloses the NTC thermistor element and the terminals, but also wherein at least one of the main surfaces of the planar NTC thermistor element makes a surface-to-surface contact with an inner wall of the case. The NTC thermistor element may be quadrangular, or polygonal more generally, and comprise an oxide of a rare earth transition element such as LaCo oxide. The power-supply terminals may comprise a metallic material such as Cu or a Cu—Ti alloy. The case may comprise a ceramic material.

An NTC thermistor embodying this invention may be conveniently inserted in series between a power source and a heat-emitting element for a heater, say, of an electronic copier, serving to fix carbon on a sheet of copy paper. If a copier is thus structured, not only can rush currents be more effectively suppressed but the rated current value can be increased.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, same or similar components are sometimes indicated by the same numerals for convenience and are not necessarily described or explained repetitiously even where they are components of different thermistors.

DETAILED DESCRIPTION OF THE INVENTION

Next, the invention is described by way of examples with reference to the drawings.

Figure 1:
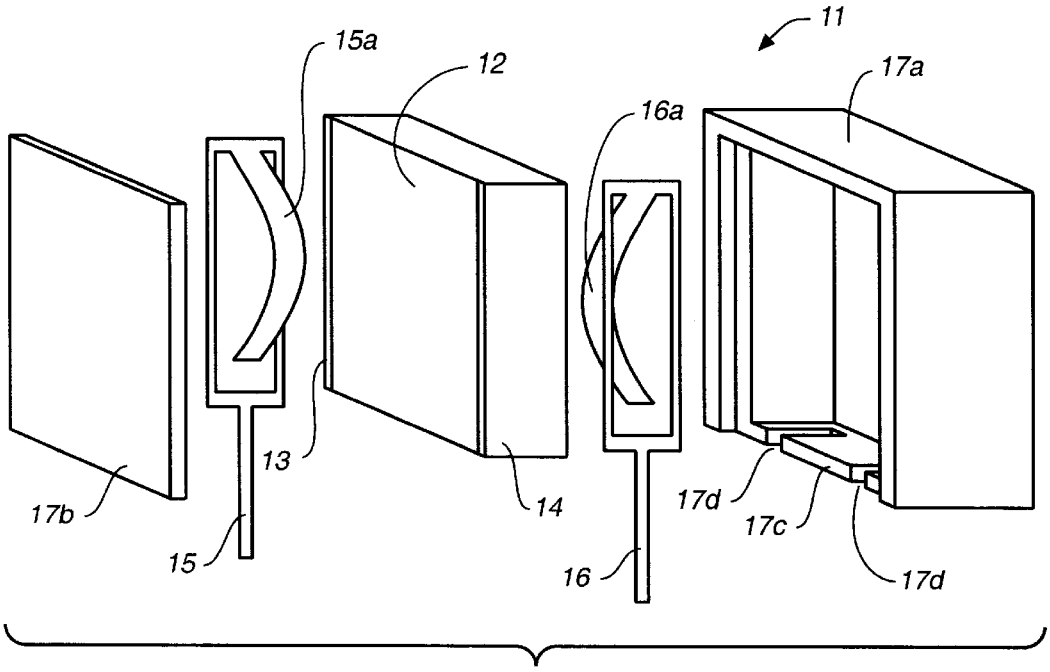
FIG. 1 is an exploded diagonal view of an NTC thermistor according to a first embodiment of this invention.

FIG. 1 shows an NTC thermistor 11 according to a first embodiment of this invention (Test Example), comprising a polygonal planar NTC thermistor element 12, a pair of elongated power-supply terminals 15 and 16 and a case 17. The NTC thermistor element 12 is obtained by molding a ceramic material comprising oxide of LaCo type rare earth transition metal with the B-constant (B(25/50)) equal to about 4000 K into a planar polygonal shape, obtaining a ceramic body by subjecting it to a firing process and forming electrodes 13 and 14 by applying an Ag paste on a pair of mutually opposite side surfaces of this ceramic body and then baking the applied Ag paste. As an example, the NTC thermistor element 12 was made quadrangular with mutually oppositely facing main surfaces with length 20 mm and width 15 mm and side surfaces connecting the main surfaces with thickness 5 mm. Its resistance at room temperature was 20 Ω. Throughout herein, the largest surfaces of such a thermistor, made in a planar shape, will be referred to as its main surfaces according to the common usage of the expression.

The power-supply terminals 15 and 16 comprise an elastic Cu-Ti alloy, having contact parts 15*a* and 16*a*, respectively.

The case 17 comprises alumina, having a generally box-shaped main body 17*a* with a hollow interior and a main surface opening to this hollow interior, as well as a lid 17*b* which covers this open main surface. A side wall 17*c* of this box-shaped main body 17*a* of the case 17 is provided with slits 17*d* for allowing the terminals 15 and 16 to pass therethrough.

The NTC thermistor element 12 is positioned inside the main body 17*a* of the case 17 so as to be sandwiched between the terminals 15 and 16 such that their contact parts 15*a* and 16*a* contact a mutually oppositely facing pair of the side walls of the NTC thermistor element 12 on which the electrodes 13 and 14 are formed and portions of the terminals 15 and 16 are inserted into the slits 17*d* on the side wall 17*c* of the main body 17*a*. The lid 17*b* is thereafter engaged with the main body 17*a* and sealed with a high-temperature resistant silicon resin material (not shown) to obtain the NTC thermistor 11.

The depth of the hollow interior of the main body 17*a* of the case 17 is designed to be approximately the same as the thickness of the NTC thermistor element 12 such that one of its main surfaces will be in a surface-to-surface contacting relationship with the bottom inner wall of the main body 17*a* while its other main surface similarly makes a surface-to-surface contact with the inner surface of the lid 17*b*.

Figure 6:
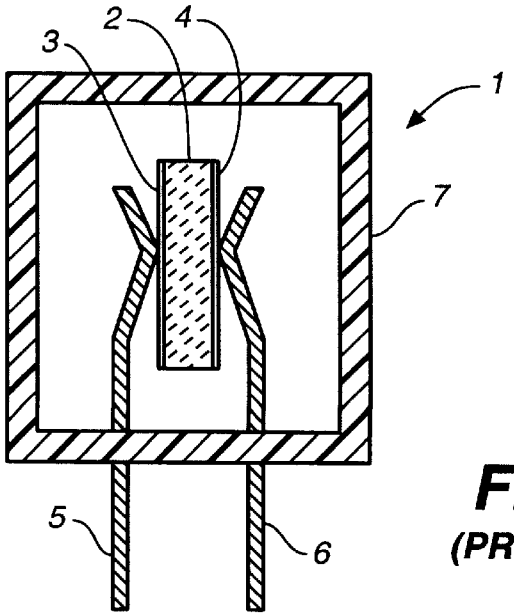
FIG. 6 (PRIOR ART)
FIG. 6 is a sectional view of a prior art NTC thermistor.

Two kinds of prior art NTC thermistors, as shown at 1 in FIG. 6, were also prepared as Comparison Examples 1 and 2. The prior art NTC thermistors of Comparison Example 1 were produced by using a ceramic material comprising 2–4 oxides of transition elements such as Mn and Ni and having the B-constant 3000K, baking it into a circular disk-shape with diameter 20 mm and thickness 5 mm so as to have an approximately the same volume as the NTC thermistors of Test Example, forming electrodes 3 and 4 of an Ag paste by baking it on both its main surfaces to produce an NTC thermistor element 2 with resistance 20 Ω at room temperature, sandwiching it with power-supply terminals 5 and 6 and putting it inside a PPS resin case.

The prior art NTC thermistors of Comparison Example 2 were produced similarly as explained above but by varying the ratio of Mn and Ni oxides or additives to produce an NTC thermistor element with resistance 6 Ω at room temperature. In summary, the prior art NTC thermistors of Comparison Examples 1 and 2 had different resistance values at room temperature but about the same B-constants. It is to be noted that the NTC thermistors of Test Example and Comparison Examples 1 and 2 were produced so as all to have about a same volume such that their thermal capacities would be about the same and hence that the effect of the present invention would be more clearly demonstrated.

Figure 2:
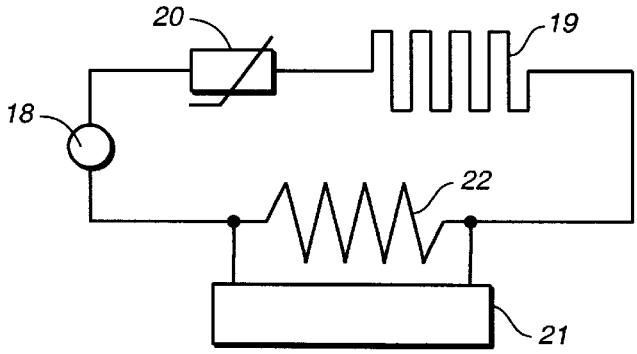
FIG. 2 is a diagram of a circuit which was used to evaluate the NTC thermistors of this invention.

Ten samples each of Test Example and Comparison Examples 1 and 2 were prepared for testing, and the relationship between the load current and the temperature of the heat-emitting element for each of the samples was determined by using a circuit as shown in FIG. 2, which may be interpreted as representing a protecting circuit for a halogen lamp of an electronic copier, serving as its fixing heater, that is, by connecting each of the samples 20 in series with a power-source 18 of 100V and a load 19 of 750 W (lamp) to measure rush currents at 25° C. A stabilized AC source was used as the power source 18 and a fixed resistor 22 of resistance 0.1 Ω, connected in parallel with an oscilloscope 21, was connected in series in order to eliminate errors due to variations in voltage. The maximum current in the waveform observed by the oscilloscope 21 was taken as the rush current and the average of ten measured current values was recorded. The results are shown in Table 1.

TABLE 1

| | Material | Resistance at 25° C. | Rush current (A) |
|---|---|---|---|
| Test Example | LaCo | 20Ω | 25.3 |
| Comparison Example 1 | MnNi | 20Ω | 37.9 |
| Comparison Example 2 | MnNi | 6Ω | 54.2 |

Table 1 shows that the rush current decreases as the resistance increases from 6 Ω to 20 Ω. This indicates that an effective way to improve the suppression of rush current is to increase the resistance. If Test Example and Comparison Example 1 are compared, it is seen that the rush current is smaller with Test Example although they have the same resistance value, that is, their heat emission is the same. In other words, it is shown that it is possible to improve the effective suppression of rush current without necessarily increasing the size of the NTC thermistor element if the NTC thermistor element is in a surface-to-surface contact with the case such that the NTC thermistor element and the case together provide a large thermal capacity. The rush current is much smaller in the case of Test Example than in the case of Comparison Example 2 because Test Example not only has a larger resistance value than Comparison Example 2 but also holds the NTC thermistor element in a surface-to-surface contacting relationship with the case such that its effective thermal capacity is increased.

Regarding Table 1, it is to be reminded that the difference in the efficacy in suppressing the rush current is not due to the difference in the value of the B-constant between the LaCo oxides and MnNi oxides of which the NTC thermistor elements ofTest and ComparisonExamples are made. The results shown in Table 1 are only due to the resistance value and thermal capacity of the NTC thermistor element.

Next, the samples of Test Example and Comparison Examples 1 and 2 were used in another experiment in which constant currents of 2A, 4A, 6A, 8A and 10A were caused to flow through them and their temperatures were measured to evaluate their rated current values. The same power source as described above for the measurement of rush currents was used for this experiment and the measurements were taken also at the same temperature. The results of this experiment are shown in FIG. 3.

Figure 3:
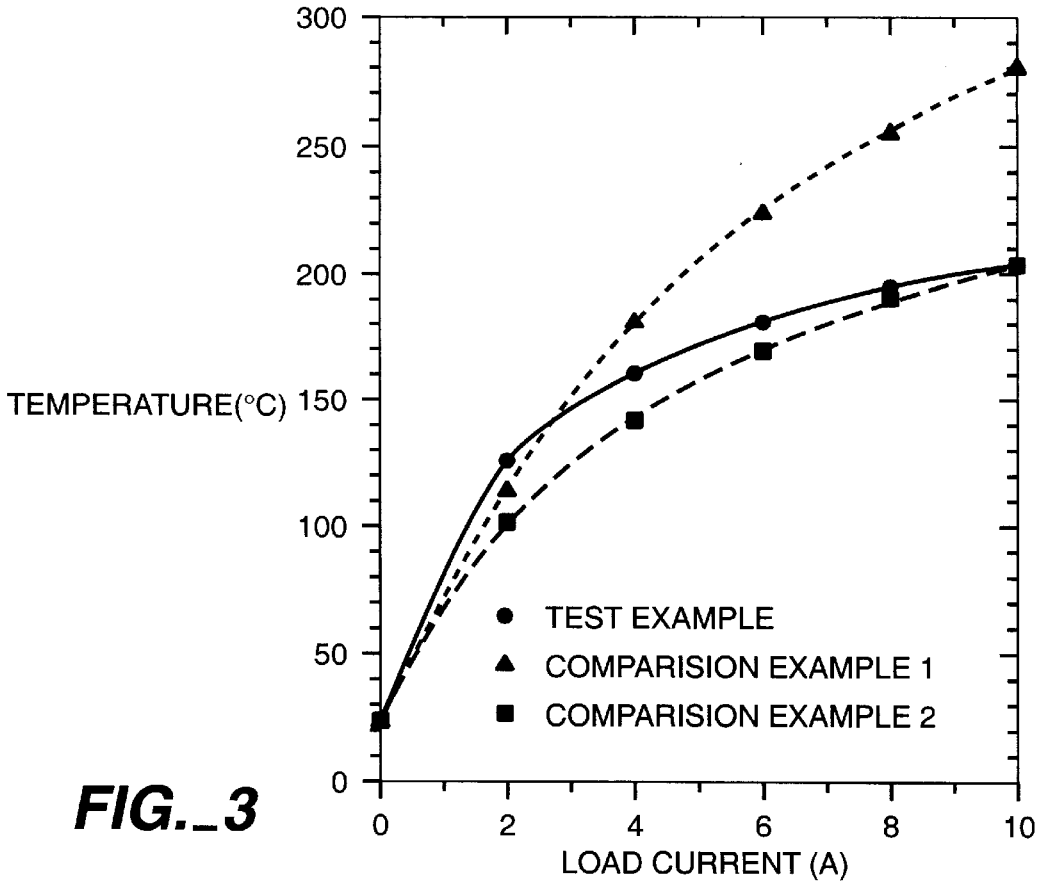
FIG. 3 is a graph showing the relationship between the load current and the temperature of heat emission.

At the load current of 10A, FIG. 3 shows that the temperature of the element was about 200° C. for Test Example but it was about 250° C. in the case of Comparison Example 1. Normally, the maximum temperature to which an NTC thermistor element of a type enclosed in a resin case is allowed to reach is set to be about 200° C. This means that a current of about 10 A can be applied to an NTC thermistor element of Test Example but only about 5 A can be applied to an NTC thermistor element of Comparison Example 1. In other words, the rated current value can be improved by changing the material for making the NTC thermistor element from oxide of MnNi type metal to an oxide of LaCo type metal with a higher B-constant because the heat emission from the NTC thermistor element can be thereby reduced. In this manner, furthermore, thermal expansion of the thermistor itself and/or the base board on which it is set can be controlled because of the lower heat emission even if the load current is the same.

If Test Example and Comparison Example 2 are compared in FIG. 3, it is seen that the elements show about the same temperature at 10 A but the element of Comparison Example 2 has a lower resistance (6 Ω), while that of Test Example shows a resistance value (20 Ω) more than three times higher. In other words, the rated current value can be made nearly equal by changing the material for the NTC thermistor element from an oxide of MnNi type to an oxide of LaCo type transition metal with a high B-constant controlling the temperature characteristic of resistance, although the resistance is more than three times higher.

Figure 4:
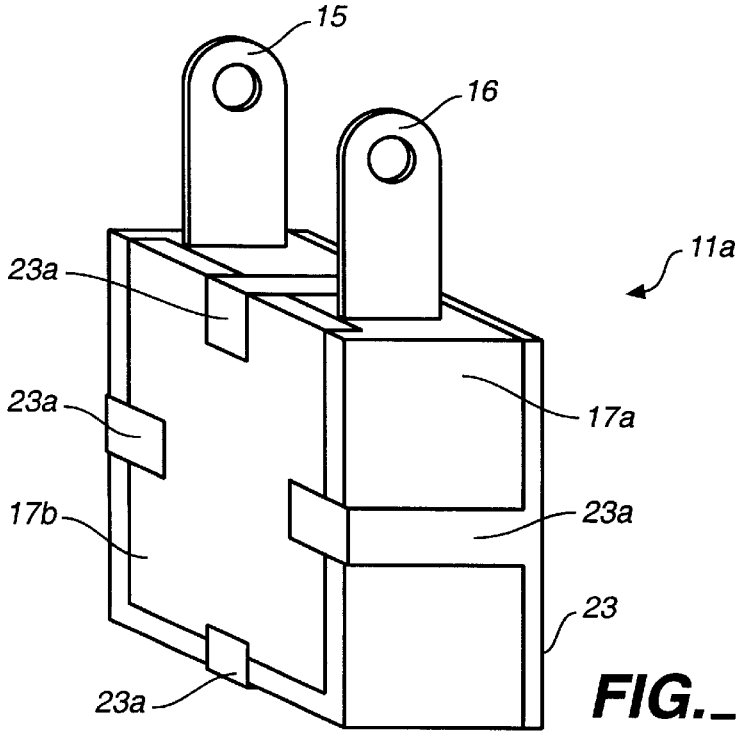
FIG. 4 is a diagonal view of another NTC thermistor according to a second embodiment of the invention.

FIG. 4 shows another NTC thermistor 11*a* according to a second embodiment of this invention. For convenience, components which are substantially similar or at least equivalent to those shown in and explained with reference to FIG. 1 are indicated by the same numerals and will not be repetitively explained.

The NTC thermistor 11*a* of FIG. 4 is characterized as comprising a holder 23 made, for example, of a metallic material for holding the main body 17*a* and the lid 17*b* of the case 17 together. For this purpose, the holder 23 has a plurality of elongated members 23*a*, each extending from one of the main surfaces of the case 17 over a side surface to reach the other of the main surfaces, such that the lid 17*b* can be securely held to the main body 17*a*.

Figure 5:
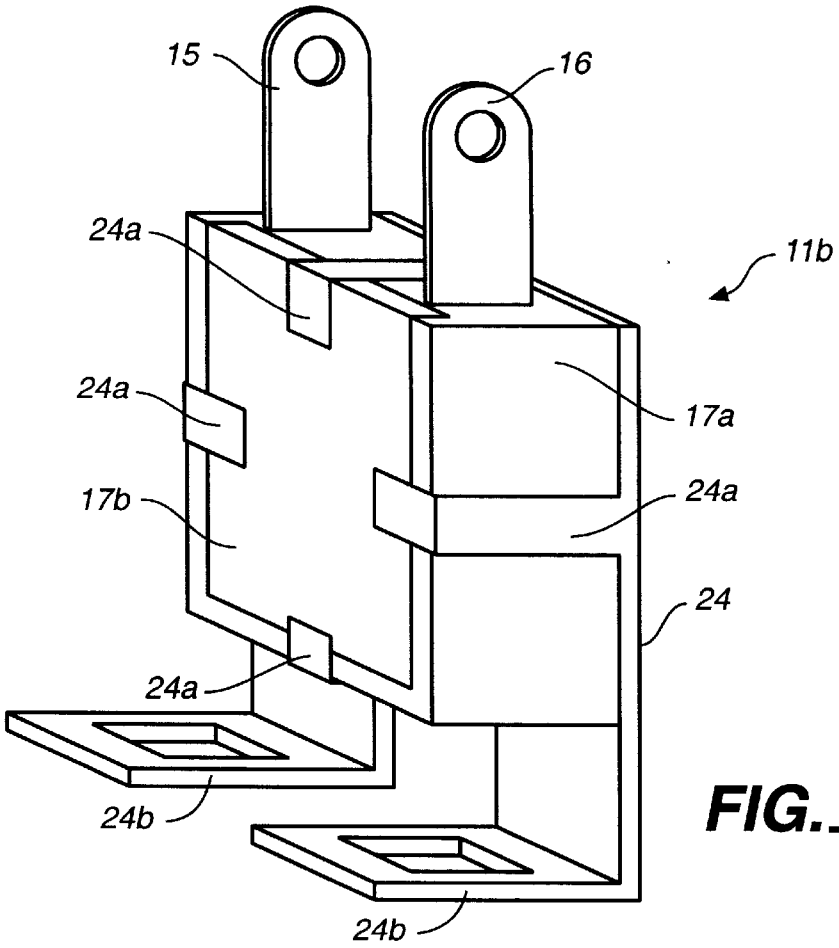
FIG. 5 is a diagonal view of still another NTC thermistor according to a third embodiment of the invention.

FIG. 5 shows still another NTC thermistor 11*b* according to a third embodiment of this invention, which is similar to the second embodiment shown in FIG. 4 wherein the main body 17*a* and the lid 17*b* of its case 17 are held together by means of a holder 24 having a plurality of similarly elongated members 24*a* but different from the second embodiment wherein the holder 24 itself is further extended beyond the area contacting the NTC thermistor element inside to form contact terminals 24*b*. The portions of the holder 24 forming the contact terminals 24*b* are bendable for the convenience of the mounting of the thermistor, say, onto a printed circuit board.

Although the invention has been described above with reference to only a limited number of embodiments, these embodiments are not intended to limit the scope of the invention. Many modifications and variations are possible within the scope of the invention. For example, although only quadrangular NTC thermistor elements were shown above, the planar shape of the NTC thermistor element according to this invention is not limited to be quadrangular, although a polygonal shape is preferred, and the expression "polygonal" is intended to be interpreted broadly, including shapes of a polygon with corners having an inner angle greater than 180°. In general, however, polygonal shapes with at least two sides allowing electrodes to be formed thereon with a fixed distance of separation therebetween are preferred because currents will flow evenly over the electrode surfaces and hence rush currents can be suppressed more effectively.

The case 17 need not be made of alumina. It may be made of mullite or another ceramic material or a non-ceramic material as long as it is highly resistant against heat, combustion and electrical conduction, capable of avoiding damage due to thermal material degradation and capable of increasing the thermal capacity of the NTC thermistor 11.

Although it is preferable, as shown in the disclosed embodiments, that the NTC thermistor element 12 make a surface-to-surface contact on both of its two main surfaces, each with an inner wall of the case 17, examples (not shown separately) wherein the NTC thermistor element makes a surface-to-surface contact over only one of its two main surfaces with an inner wall of the case 17 are also to be considered within the scope of the invention. In addition to either or both of the two main surfaces of the NTC thermistor element, those of its side surfaces of the NTC thermistor element on which electrodes are not formed may be designed to also make a surface-to-surface contact with an inner wall of the case 17.

As for the power-supply terminals 15 and 16, they may as well comprise an elastic metallic material with similar thermal expansion such as Cu. Metallic materials with high resistivity such as Ni may also be used with an electroconductive plating thereon.

The electrodes for the NTC thermistor need not comprise Ag. Noble metals such as Pd, Pt and Au, as well as alloys of two or more thereof, may be used to print and bake a paste. Similar effects of the invention can be obtained by sputtering, ion plating and other methods with the use of a metal or an alloy capable of making an ohmic contact with the NTC thermistor element.

NTC thermistors according to this invention are useful if incorporated in an electronic copier. In the fixing process, electronic copiers make use of a heat roller to fix carbon particles on paper. A halogen lamp is usually used as the heat source of such a heat roller and a current is switched on and off for the fixing process. An NTC thermistor is inserted in series between the halogen lamp and its power source for preventing the destruction of the halogen lamp by a rush current when the circuit is switched on. In such an application, NTC thermistors of the present invention are particularly valuable for their improved ability to suppress a rush current.

What is claimed is:

1. An NTC thermistor comprising:

a planar NTC thermistor element having a pair of main surfaces and electrodes formed on a mutually opposite pair of side surfaces which extend between said pair of main surfaces, said main surfaces being the largest surfaces of said planar NTC thermistor element;

power-supply terminals each having a protruding contact part and electrically connected to and elastically contacting a different one of said electrodes; and a case with inner walls and a lid which encloses said NTC thermistor element and said power-supply terminals therein, one of said main surfaces of said NTC thermistor element being in a surface-to-surface contact with one of said inner walls of said case, the other of said main surfaces of said NTC thermistor element being in a surface-to-surface contact with said lid.

2. The NTC thermistor of claim 1 wherein said planar NTC thermistor element is polygonal.

3. The NTC thermistor of claim 1 wherein said planar NTC thermistor element comprises an oxide of a rare earth transition metal.

4. The NTC thermistor of claim 3 wherein said oxide of rare earth transition metal is an oxide of LaCo rare earth transition metal.

5. The NTC thermistor of claim 1 wherein said power-supply terminals comprise a metallic material including Cu.

6. The NTC thermistor of claim 5 wherein said metallic material comprises an Cu—Ti alloy.

7. The NTC thermistor of claim 1 wherein said case is made of a ceramic material.

8. A circuit element for an electronic copier, said circuit element comprising:

an electrical power source;

an electrical heat source for a heater; and an NTC thermistor connected in series between said electrical power source and said electrical heat source, said NTC thermistor comprising:

a planar NTC thermistor element having a pair of main surfaces and electrodes formed on a mutually opposite pair of side surfaces which extend between said pair of main surfaces, said main surfaces being the largest surfaces of said planar NTC thermistor element;

power-supply terminals each having a protruding contact part and electrically connected to and elastically contacting a different one of said electrodes; and a case with inner walls and a lid which encloses said NTC thermistor element and said power-supply terminals therein, one of said main surfaces of said NTC thermistor element being in a surface-to-surface contact with one of said inner walls of said case, the other of said main surfaces of said NTC thermistor element being in a surface-to-surface contact with said lid.

9. The circuit element of claim 8 wherein said planar NTC thermistor element is polygonal.

10. The circuit element of claim 9 wherein said planar NTC thermistor element comprises an oxide of a rare earth transition metal.

11. The circuit element of claim 10 wherein said oxide of rare earth transition metal is an oxide of LaCo rare earth transition metal.

12. The circuit element of claim 8 wherein said power-supply terminals comprise a metallic material including Cu.

13. The circuit element of claim 12 wherein said metallic material comprises an Cu—Ti alloy.

14. The circuit element of claim 8 wherein said case is made of a ceramic material.

15. The NTC thermistor of claim 1 wherein said lid seals said case with a silicon resin material.

16. The circuit element of claim 8 wherein said lid seals said case with a silicon resin material.

* * * * *